United States Patent [19]

Bailey

[11] 4,159,790

[45] Jul. 3, 1979

[54] DISPENSING CONTAINER

[76] Inventor: Vincent R. Bailey, 2914 N. Flagler Dr., W. Palm Beach, Fla. 33407

[21] Appl. No.: 862,108

[22] Filed: Dec. 19, 1977

[51] Int. Cl.[2] ..... B65D 37/00

[52] U.S. Cl. ..... 222/211; 222/212; 222/386.5; 222/464

[58] Field of Search ..... 222/211–213, 222/215, 386.5, 464, 568, 95; 239/327

[56] References Cited

U.S. PATENT DOCUMENTS

| | | | |
|---|---|---|---|
| 1,457,895 | 6/1923 | Campanella | 239/327 X |
| 2,752,199 | 6/1956 | Newell, Jr. | 222/211 X |
| 3,240,399 | 3/1966 | Frandeen | 222/212 X |
| 3,705,668 | 12/1972 | Schwartzman | 222/213 X |
| 3,874,562 | 4/1975 | Hazard | 222/211 X |
| 3,963,150 | 6/1976 | Steiman et al. | 222/211 |

FOREIGN PATENT DOCUMENTS

| | | | |
|---|---|---|---|
| 961015 | 1/1975 | Canada | 222/211 |
| 679400 | 12/1964 | Italy | 239/327 |

*Primary Examiner*—Robert J. Spar
*Assistant Examiner*—Charles A. Marmor

[57] ABSTRACT

A dispensing container comprising a compressible bottle having a neck portion, a cap attached to the neck portion, the cap having an inlet extending through the cap, a first one-way valve disposed in the inlet and operable to permit flow of air through the inlet into the bottle, the cap having an outlet extending through the cap, a second one-way valve disposed in the outlet and operable to permit flow of liquid from the bottle through the outlet, the cap having a protrusion extending into the neck portion of the bottle, the outlet extending through the protrusion, a tube connected to the protrusion and extending toward a bottom portion of the bottle, and a flexible bag having a neck portion fixed to the tube, the bag being disposed in the bottle and being adapted to retain the liquid therein, the tube having opening means to facilitate flow of the liquid into the tube.

6 Claims, 2 Drawing Figures

Fig. 1
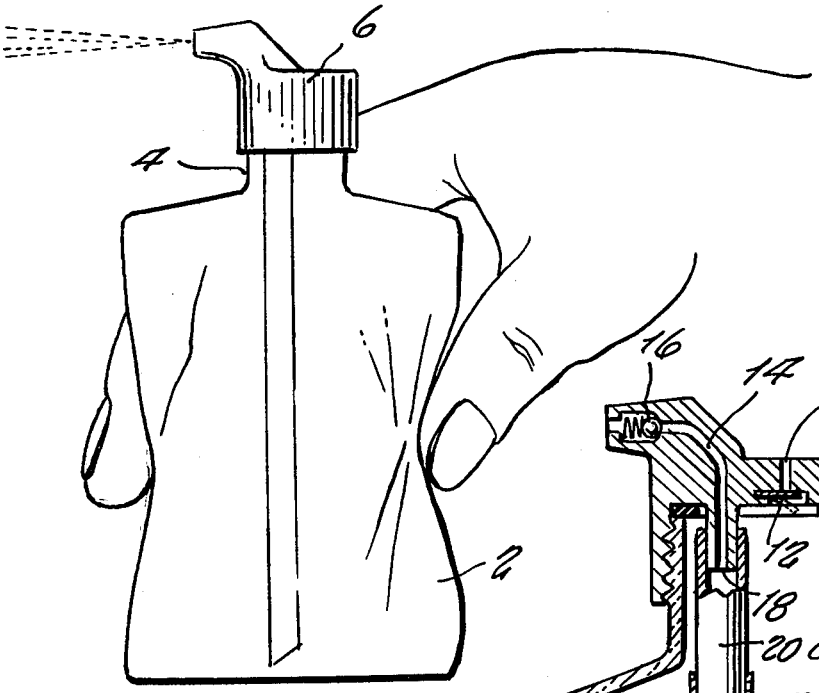
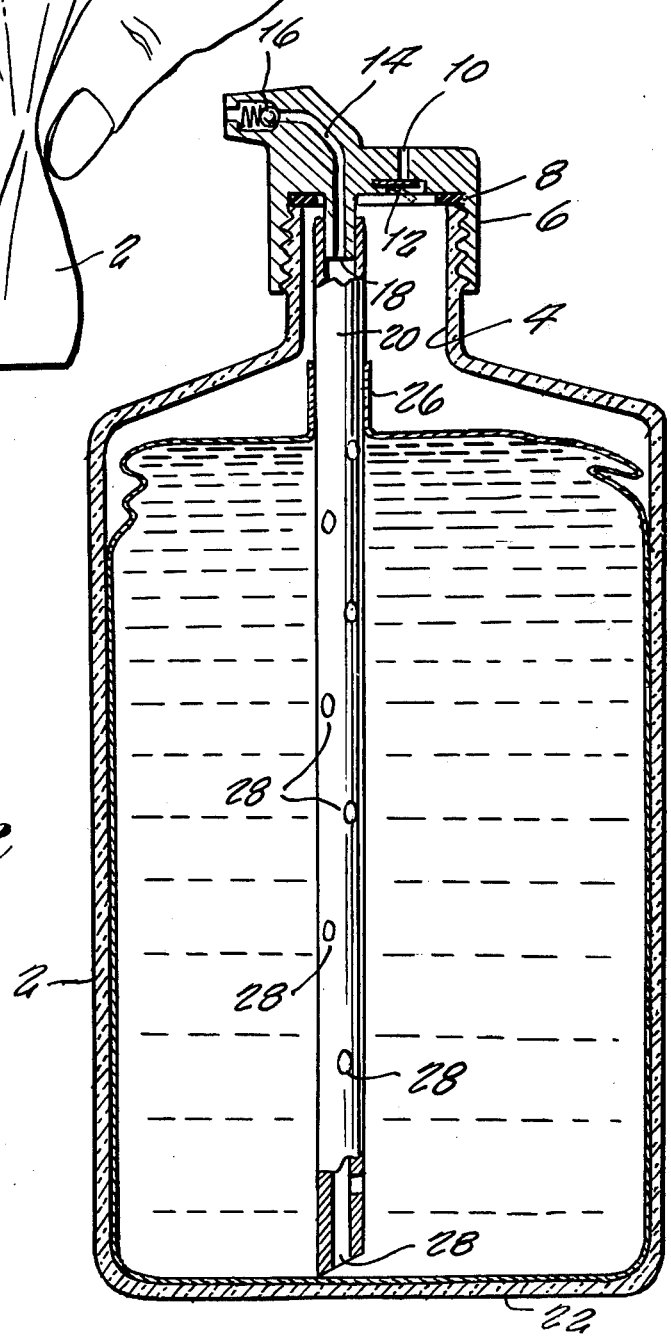
Fig. 2

DISPENSING CONTAINER

BACKGROUND OF THE INVENTION

1. Field of the Invention

This invention relates to dispensing containers and is directed more particularly to a flexible wall plastic container for dispensing fluids.

2. Description of the Prior Art

Dispensing containers of the compressible type are generally known in the art.

Examples of such devices may be found in U.S. Pat. No. 2,577,321 issued Dec. 4, 1951 to J. B. Filger; U.S. Pat. No. 3,152,734 issued Oct. 13, 1964 to J. M. Berry; U.S. Pat. No. 3,170,633 issued Feb. 23, 1965 to C. Castelli; U.S. Pat. No. 3,181,745 issued May 4, 1965 to B. T. Grobowski; U.S. Pat. No. 3,263,873 issued Aug. 2, 1966 to D. F. Armour; U.S. Pat. No. 3,506,162 issued Apr. 14, 1970 to G. Schwartzman; U.S. Pat. No. 3,628,700 issued Dec. 21, 1971 to R. J. Dodoghue, and U.S. Pat. No. 3,648,903 issued Mar. 14, 1972 to P. A. Marchant.

SUMMARY OF THE INVENTION

An object of the present invention is to provide a simple and inexpensive dispensing container of the squeeze bottle type.

With the above and other objects in view, as will hereinafter appear, a feature of the present invention is the provision of a dispensing container comprising a compressible bottle having a neck portion, a cap attached to the neck portion, the cap having an inlet extending through the cap, a first one-way valve disposed in the inlet and operable to permit flow of air through the inlet into the bottle, the cap having an outlet extending through the cap, a second one-way valve disposed in the outlet and operable to permit flow of liquid from the bottle through the outlet, the cap having a protrusion extending into the neck portion, the outlet extending through the protrusion, a tube connected to the protrusion and extending toward a bottom portion of the bottle, and a flexible bag having a neck portion fixed to the tube, the bag being disposed in the bottle and being adapted to retain the liquid therein, the tube having opening means to facilitate flow of the liquid into the tube.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

FIG. 1 is a side elevational view of one form of dispensing container illustrative of an embodiment of the invention shown in operation; and FIG. 2 is a center line sectional view of the dispensing container of FIG. 1.

DESCRIPTION OF THE PREFERRED EMBODIMENT

Referring to the drawings, it will be seen that the illustrative dispensing container comprises a compressible bottle 2 having a neck portion 4. A cap 6 is attached to the neck portion 4, as by threaded engagement. A sealing ring 8 may be provided to insure a leak-free interfit between the neck portion 4 and the cap 6.

The cap 6 is provided with an inlet 10 extending through the cap. A first one-way valve 12 is provided in the inlet 10 and operable to permit flow of air through the inlet 10 into the bottle 2. The cap is further provided with an outlet 14 extending through the cap. A second one-way valve 16 is disposed in the outlet 14 and is operable to permit flow of liquid from the bottle through the outlet to the atmosphere.

The cap 6 is provided with a protrusion 18 extending into the neck portion 4 of the bottle 2, the outlet 14 extending axially through the protrusion 18. A tube 20 is connected to the protrusion 18 and extends toward a bottom portion 22 of the bottle 2.

A flexible bag 24 is provided having a neck portion 26 which is fixed to the tube 20. As may be seen in FIG. 2, the bag 24 is disposed in the bottle 2 and is adapted to retain liquid therein. The tube 20 is provided with opening means 28 to facilitate flow of the liquid into the tube. In addition to the opening at the bottom of the tube 20, the opening means 28 include a series of openings disposed along the length of the tube. Thus, if the dispenser is tilted at such an angle as to foreclose the entry of liquid into the tube through the opening at the bottom of the tube, the fluid may enter the tube by the openings spaced along the wall of the tube.

In the embodiment shown, the first one-way valve 12 comprises a flap valve which operates to permit air to be drawn into the interior of the bottle but not to be discharged. The second one-way valve 16 preferably comprises a ball valve which is operable to permit dispensing of fluid from the container but to foreclose entry of fluid into the container by way of the valve 16.

In operation, the bottle 2 is squeezed, as shown in FIG. 1, forcing the liquid contents of the bag 24 up through the tube 20 and the outlet 14 to unseat the ball valve 16 and dispense the fluid into the atmosphere. Upon release of the bottle 2 the wall structure of the bottle returns to its original shape, drawing air through the inlet 10 past the flap 12 and causing the ball 16 to seat, to close the outlet 14. Upon resumption of its original shape, the intake of air through the inlet 10 ceases and the flap 12 snaps back to the closed position. Thereupon, the bottle is ready for another dispensing operation.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A dispensing container comprising a compressible bottle having a neck portion, a cap comprising a cylindrical wall portion, a top portion and spout portion attached to said neck portion, said cap having an inlet passageway extending through said top portion of said cap in a direction axially of said bottle, a first one-way valve disposed in said inlet passageway and operable to permit flow of air through said inlet passageway into said bottle, said cap having an outlet passageway extending through said spout portion of said cap, said spout portion being fixed at an angle to the axis of said bottle, said outlet passageway having a chamber therein, a second one-way valve disposed in said outlet passageway chamber and operable to permit flow of liquid from said bottle through said outlet passageway, said cap having as an integrally molded portion thereof a cylindrical protrusion extending into said neck portion along a line off-set from said axis of said bottle, said outlet passageway extending axially of said protrusion and parallel to said inlet passageway, a tube fitted upon said protrusion and extending toward a bottom portion of said bottle, and a flexible bag having a cylindrical neck portion off-set from a lengthwise axis of said bag and fixed upon said tube, said bag being disposed in said bottle and being adapted to retain said liquid therein, a portion of said tube disposed within said bag having opening means to facilitate flow of said liquid into said tube, said opening means comprising a plurality of holes in wall portions of said tube disposed within said bag, said tube being devoid of openings in a portion thereof outside of said bag.

2. The invention according to claim 1 in which said first one-way valve comprises a flap valve.

3. The invention according to claim 2 in which said second one-way valve comprises a ball valve.

4. The invention in accordance with claim 1 in which an opening is disposed at an end of said tube remote from said cap, said end of said tube being bevelled.

5. The invention in accordance with claim 1 in which said cap is threadedly connected to said bottle neck portion, and including a sealing ring disposed between said bottle neck portion and said cap.

6. The invention in accordance with claim 1 in which said first one-way valve comprises a flap valve hingedly anchored in said cap and said second one-way valve comprises a spring-biased ball valve comprising a coil spring and ball disposed in said chamber in said outlet passageway.

* * * * *